US005522362A

United States Patent [19]

Motose

[11] Patent Number: 5,522,362

[45] Date of Patent: Jun. 4, 1996

[54] IDLE CONTROL ARRANGEMENT FOR ENGINE

[75] Inventor: Hitoshi Motose, Hamamatsu, Japan

[73] Assignee: Sanshin Kogyo Kabushiki Kaisha, Hamamatsu, Japan

[21] Appl. No.: 438,424

[22] Filed: May 10, 1995

[30] Foreign Application Priority Data

May 10, 1994 [JP] Japan ..... 6-119722
May 10, 1994 [JP] Japan ..... 6-119723

[51] Int. Cl.[6] ..... F02M 35/10; F02M 3/12; F02B 33/04

[52] U.S. Cl. ..... 123/339.13; 123/73 A; 123/184.21

[58] Field of Search ..... 123/339.1, 339.13, 123/73 A, 184.21, 184.31

[56] References Cited

U.S. PATENT DOCUMENTS 4,474,152 10/1984 Horiuchi et al. ..... 123/339.13
4,838,224 6/1989 Cheng ..... 123/339.13
5,000,134 3/1991 Fujimoto et al. ..... 123/73 A
5,090,380 2/1992 Suzuki et al. ..... 123/339.13
5,140,964 8/1992 Torigai ..... 123/73 A
5,207,190 5/1993 Torigai et al. ..... 123/73 A
5,231,958 8/1993 Takahashi et al. ..... 123/73 A
5,341,772 8/1994 Dohring et al. ..... 123/339.1

*Primary Examiner*—Willis R. Wolfe
*Attorney, Agent, or Firm*—Knobbe, Martens, Olson & Bear

[57] ABSTRACT

An improved idle speed control arrangement that embodies an idle air passage formed in a member of the induction system that is downstream of the throttle valves. The idle air passage is formed by a groove in a face of the member that is closed by engagement with another member of the induction system. The idle speed is controlled by controlling the flow of air to the idle passage from an atmospheric air inlet.

16 Claims, 8 Drawing Sheets

62
56
57
61
29
31
32
34
28
33
33
56
58
35
29
31
32
34
28
33
56
33
57
36
29
31
32
34
28
33
33
S
59

41
54
47
42
53
41
49
48
43
51
38
42
41
49
43
51
49
41
42
43

IDLE CONTROL ARRANGEMENT FOR ENGINE

This invention relates to an idle control system for an engine, and more particularly to an improved apparatus for controlling the idle speed of an engine.

Spark-ignited engines, as is well known, employ a throttle valve arrangement for controlling the speed of the engine by controlling the amount of intake air flow. Normally, butterfly-type throttle valves are employed for this purpose, but other types of throttle valves also may be employed. With this type of arrangement, the idle speed of the engine is normally controlled by adjusting the idle position of the throttle valve. This arrangement has a number of disadvantages.

First, many engines employ multiple throttle valves. When multiple throttle valves are employed, then there must be incorporated an interconnecting linkage system, and the idle position of each throttle valve must be set so that all throttle valves will be at the same position during idle. This involves complex synchronization.

In addition to this problem, the actual airflow area of the throttle body, particularly with butterfly-type throttle valves, does not vary linearly with the angular position. In addition, the actual airflow through the throttle body does not even vary linearly with respect to the flow area. Therefore, a given degree of change in throttle position will not always provide the same degree of change in engine speed or engine output.

It is, therefore, a principal object of this invention to provide an improved idle control system for an engine.

It is a further object of this invention to provide an improved and simplified idle control for an engine having a plurality of throttle valves.

Another way that idle speed may be controlled is by providing a bypass passage around the throttle valve and controlling the airflow through this bypass passage. However, the way this has been done is to provide external plumbing in order to provide the bypass passages. This provides not only a complex structure, but also one which is expensive to install and maintain.

It is, therefore, a still further object of this invention to provide an improved and simplified idle bypass arrangement for an internal combustion engine.

SUMMARY OF THE INVENTION

This invention is adapted to be embodied in an intake system for an internal combustion engine having a plurality of intake ports serving a plurality of combustion chambers of the engine. A throttle body assembly is affixed to the engine and has a plurality of flow passages, each communicating with a respective one of the intake ports. A plurality of throttle valves is supported by the throttle body assembly for controlling the flow through the flow passages and the intake ports. The throttle body assembly includes an idle air passage formed integrally therein downstream of the throttle valves and having an atmospheric air inlet for drawing atmospheric air and delivering it to the intake ports for idle operation.

DETAILED DESCRIPTION OF THE PREFERRED EMBODIMENTS OF THE INVENTION

Figure 1:
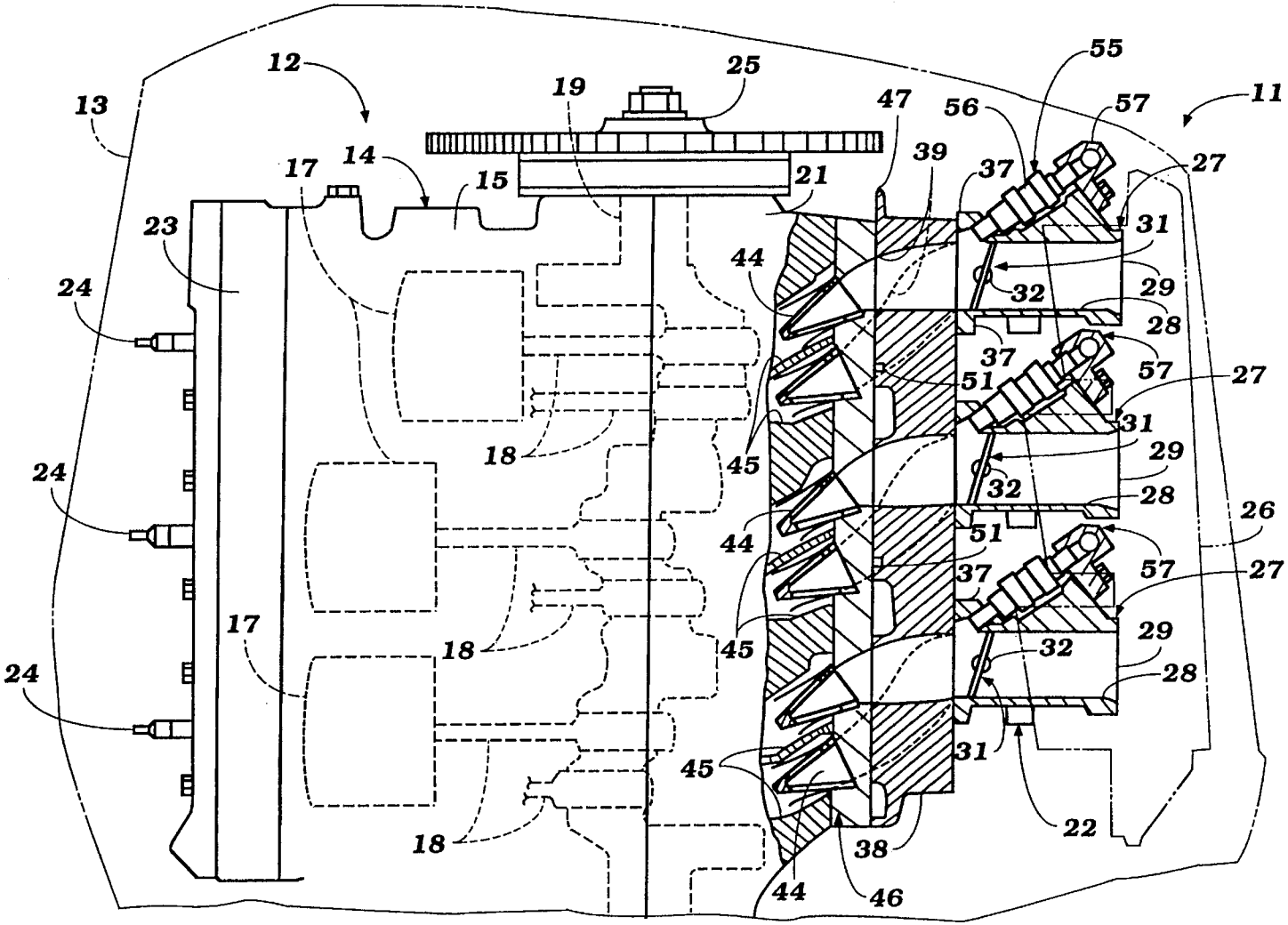
FIG. 1 is a side elevational view of the power head of an outboard motor constructed in accordance with an embodiment of the invention, with the induction system shown in a cross section taken along a line 1—1 of FIG. 2 and with the protective cowling shown in phantom.
Figure 2:
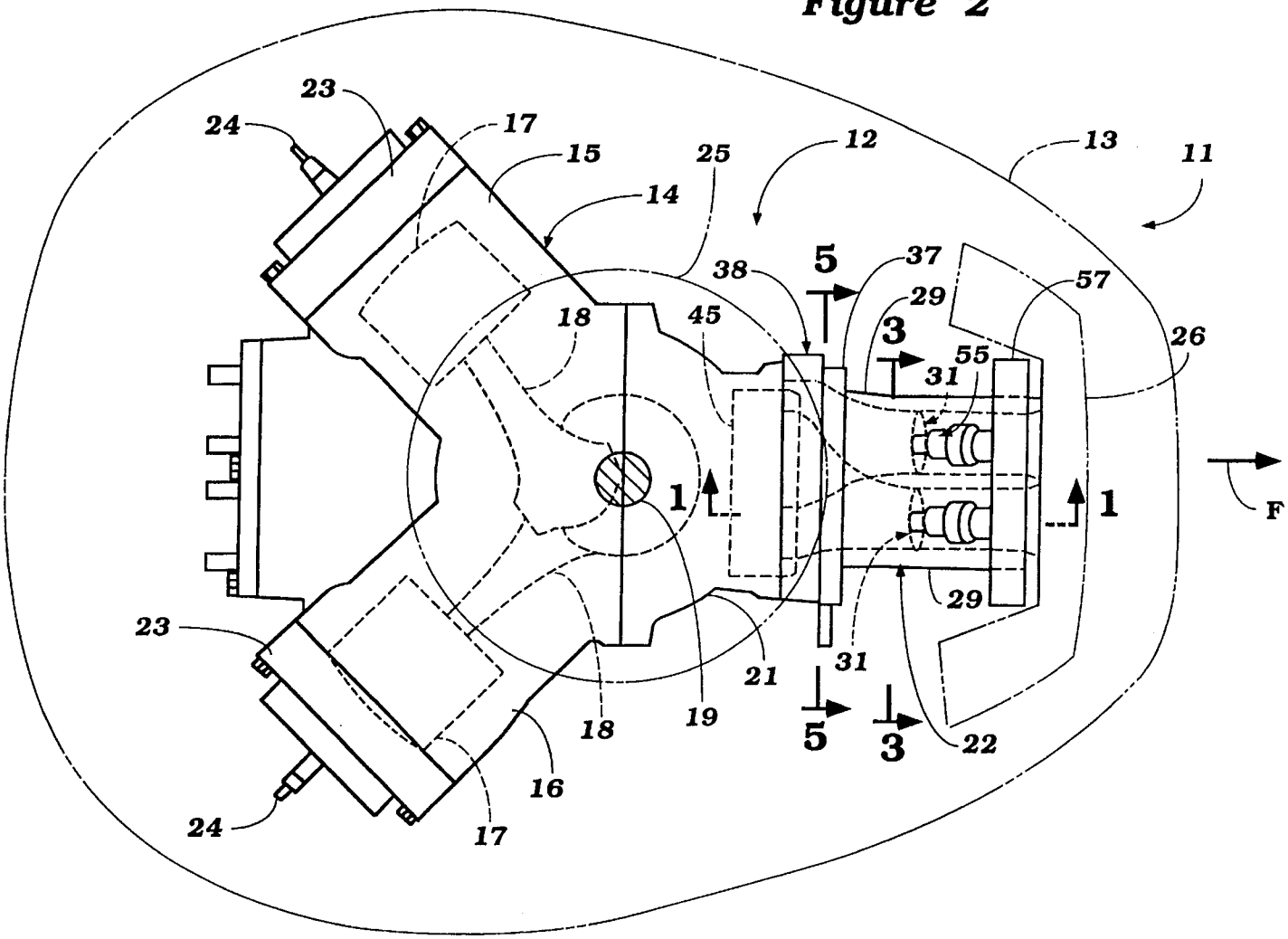
FIG. 2 is a top plan view of the power head, again showing the protective cowling in phantom.

Referring now in detail to the drawings, and initially to the embodiment of FIGS. 1–6 and initially primarily to FIGS. 1 and 2, the power head of an outboard motor is shown partially and is identified generally by the reference numeral 11. The invention is described in conjunction with an outboard motor because this is a typical environment in which the invention may be practiced. It will be readily apparent, however, to those skilled in the art that the invention is capable of use in a wide variety of applications for internal combustion engines. The invention, in some respects, has particular utility in conjunction with two-cycle crankcase compression engines, and since such engines are frequently employed in conjunction with outboard motors, the outboard motor is a typical environment in which the invention may be utilized.

The outboard motor 11 includes an internal combustion engine, indicated generally by the reference numeral 12, and a surrounding protective cowling, shown in phantom and indicated by the reference numeral 13.

In the embodiment illustrated, the engine 12 is of the V-6 type and, accordingly, is provided with a cylinder block 14 having angularly disposed cylinder banks 15 and 16. Each cylinder bank is formed with three cylinder bores, each of which receives a respective piston 17. The pistons 17 are connected by means of piston pins (not shown) to the upper or small ends of connecting rods 18. The connecting rods 18 have their lower or big ends journalled on a crankshaft 19 in a well-known manner. As is typical with V-type engine practice, the cylinders of the cylinder bank 15 are offset from those of the cylinder bank 16 so that the connecting rods 18 of adjacent cylinders of each bank may be journalled on a common throw of the crankshaft 19.

As is typical in outboard motor practice, the engine 12 is provided in the power head in such a manner so that the crankshaft 19 locates about a vertically extending axis. This is to facilitate connection of the lower end of the crankshaft 19 to a drive shaft (not shown) that depends into a drive shaft housing and lower unit for driving a propulsion device such as a propeller or the like for propelling an associated watercraft.

The crankshaft 19 is rotatably journalled in a crankcase assembly formed by a skirt of the cylinder block 14 and a crankcase member 21 that is affixed thereto in a known manner. As is typical with two-cycle crankcase compression engines, the crankcase chamber associated with each of the pistons 17 is sealed from the others so that the intake charge can be drawn into it through an induction system, indicated generally by the reference numeral 22, and which will be described later by reference to the remaining figures of this embodiment. This charge is then compressed in the crankcase chambers and transferred to the combustion chamber formed above the pistons 17 by the cylinder bores and by cylinder heads 23 that are affixed to the cylinder blocks 15 and 16 in a known manner.

The charge is then fired by spark plugs 24 that are fired by an ignition system which includes a flywheel magneto 25 affixed to the upper end of the crankshaft 19. The burnt charge is then discharged to the atmosphere through an exhaust system in a well-known manner.

The construction of the engine 12 as thus far described may be considered to be conventional, and for that reason, further details of the basic engine construction are not believed to be necessary to enable those skilled in the art to practice the invention. As should be apparent from the foregoing description, the invention deals primarily with the induction system 22, and specifically the throttle and idle control arrangements therefor.

The induction system 22 includes an air inlet device of any known type, indicated by the reference numeral 26. Since it, per se, forms no part of the invention, it is shown in phantom, and further description of it is not believed to be necessary. However, the inlet device 26 draws atmospheric air from within the protective cowling 13 in a manner as well known in this art. The cowling 13 is provided with an appropriate atmospheric air inlet for this purpose.

A plurality of throttle bodies, each indicated by the reference numeral 27, has a pair of parallel intake passages 28 that extend from inlet openings 29 formed in the interior of the air inlet device and receive this atmospheric air. In the illustrated embodiment, since the engine 12 is of the V-6 type, there are provided three throttle bodies, each having a pair of side-by-side inlet passages 28.

A butterfly-type throttle valve assembly 31 is supported in each of these intake passages 28 on a respective throttle valve shaft 32. That is, each throttle body has one throttle valve shaft 32 on which two butterfly-type throttle valves 31 are affixed.

Figure 3:
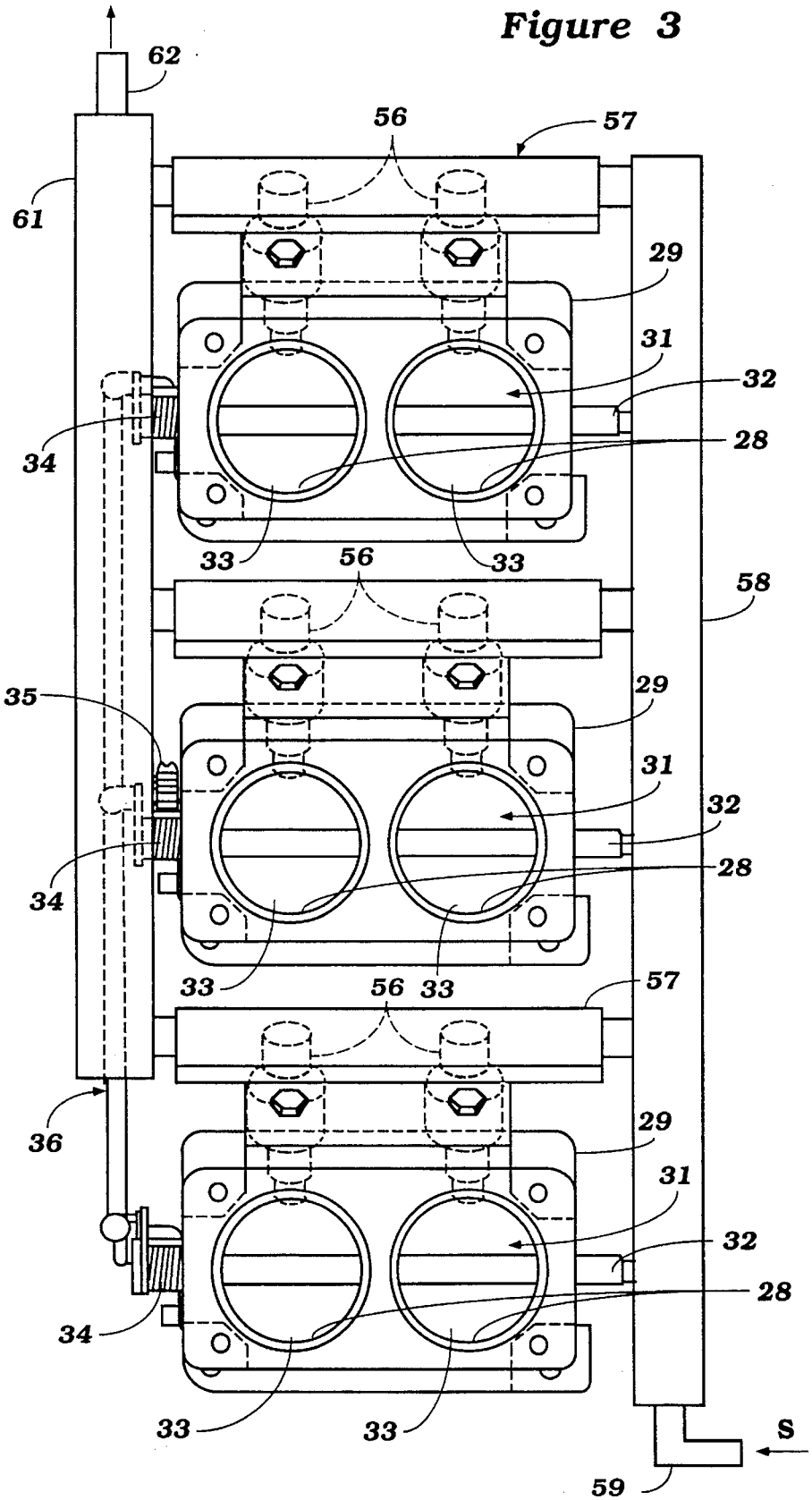
FIG. 3 is a view taken in the direction of the line 3—3 of FIG. 2 and shows the throttle bodies of the induction system and the associated components.
Figure 4:
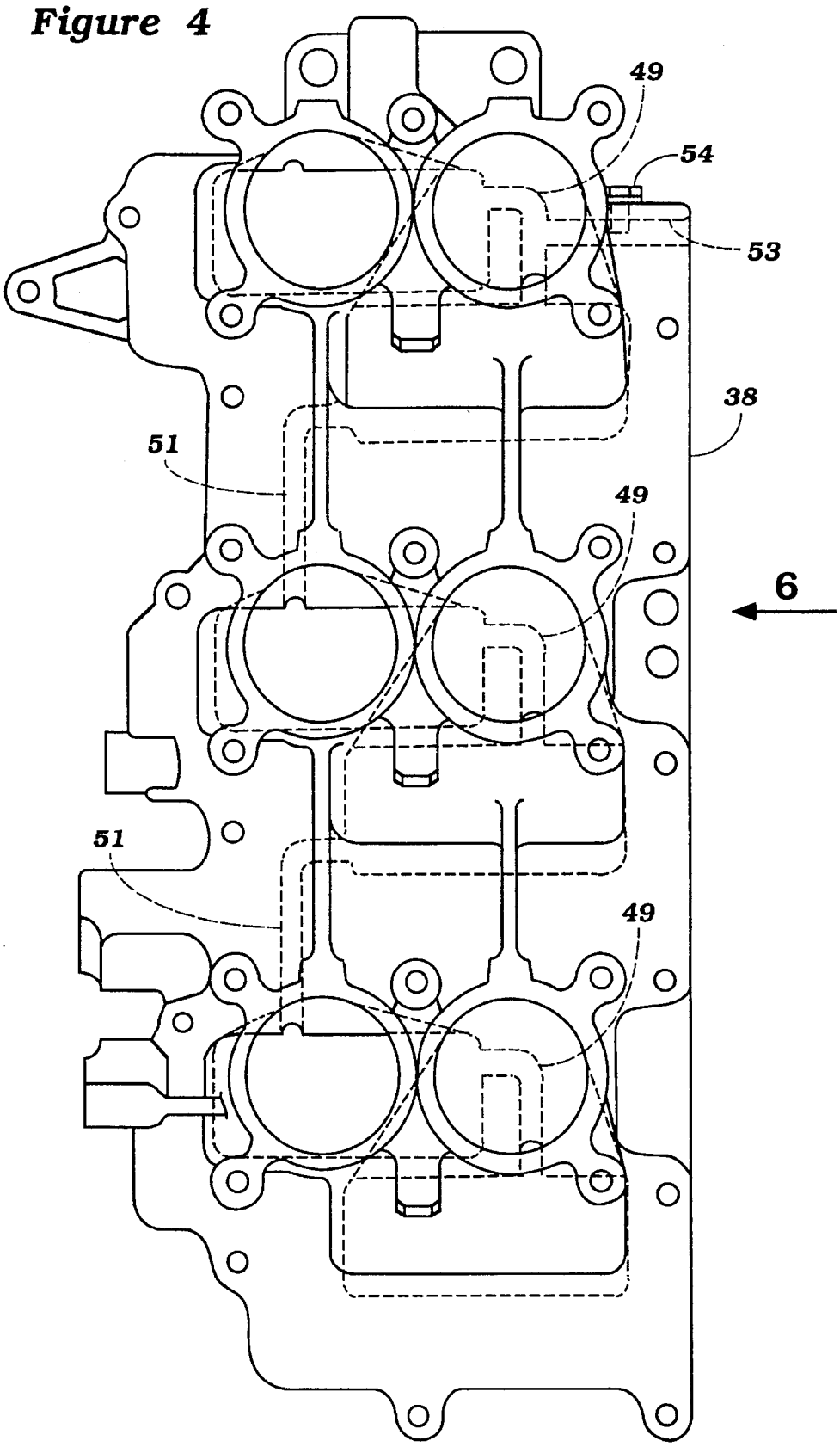
FIG. 4 is a view of the intake manifold associated with the throttle bodies and looking in the direction opposite to that of FIG. 3 in the plane 3—3 of FIG. 2.
Figure 5:
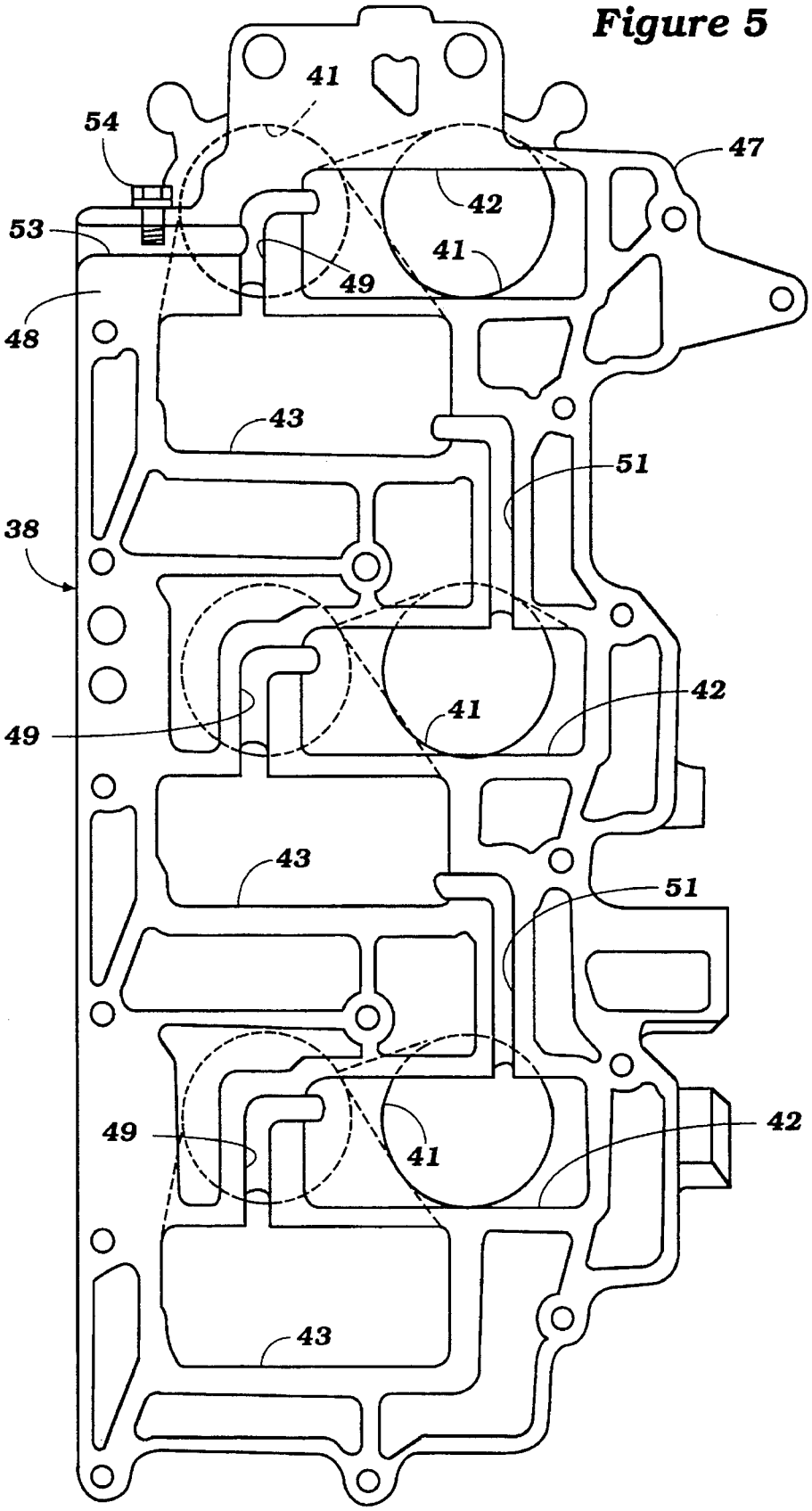
FIG. 5 is a view of the opposite side of the intake manifold taken along the plane 5—5 of FIG. 2.
Figure 6:
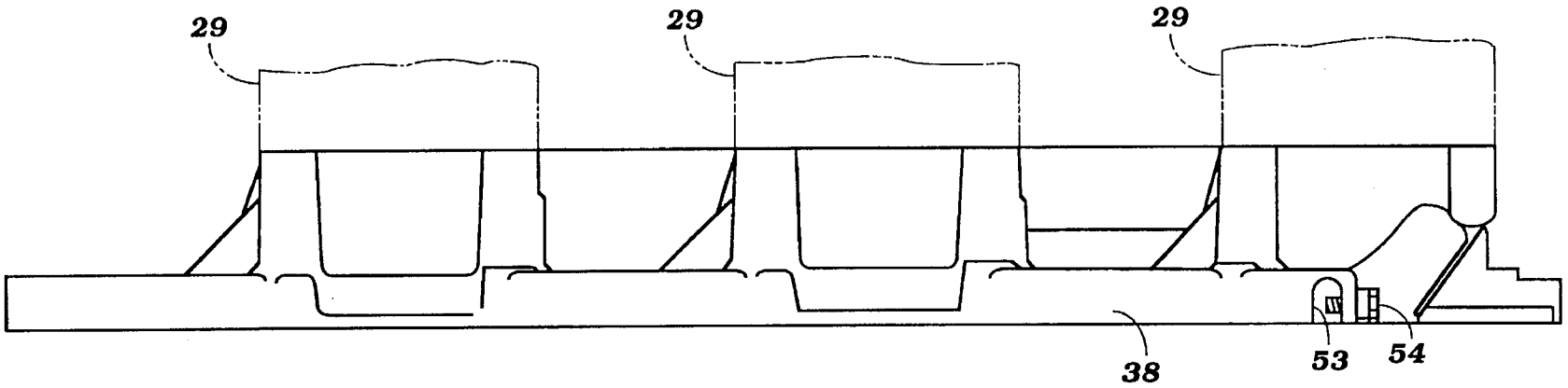
FIG. 6 is a view of the intake manifold taken in the direction of the arrow 6 in FIG. 4.

As may be best seen in FIG. 3, the butterfly-type throttle valves 31 include circular valve plates 33, each of which is positioned in a respective one of the intake passages 28 and which has a diameter that is substantially equal to the respective intake passage 28.

Torsional springs 34 encircle one end of the throttle valve shafts 32 and urge the throttle valves 33 and throttle valve shafts 32 toward a closed positioned. An adjusting screw 35 cooperates with one of the throttle valve shafts 32 so as to control this extreme position. A linkage arrangement 36 interconnects the throttle valve shafts 32 so that they are simultaneously operated. This linkage system is connected to a remote actuator (not shown) so that the throttle valve position can be controlled by an operator at the remote location.

Each throttle body 27 is provided with a flanged base portion 37 that is detachably connected to a common intake manifold 38. The intake manifold 38 is formed with pairs of side-by-side intake passages 39 which have generally circular intake ends 41 that are complimentary in shape to the throttle body intake passages 28 and then merge into generally rectangular outlet portions. These outlet portions are indicated by the reference numerals 42 and 43, and as may be seen in FIGS. 1 and 5 the outlet portions 42 are disposed vertically above the outlet portions 43. The spacing between the outlet portions 42 and 43 in a vertical direction is the same as the offset of the cylinder banks 15 and 16 from each other. As has been noted, the cylinder banks are offset so that the connecting rods 18 of each cylinder bank may be positioned in side-by-side relationship on the same throws of the crankshaft 19.

Reed-type check valves 44 are provided in intake ports 45 formed in the crankcase member 21 and which cooperate with the respective crankcase chambers, previously referred to. The reed-type check valves 44 may be formed with a common valve plate 46 that is sandwiched between a flange 47 of the intake manifold 38 and the mating face of the crankcase chamber 21. The various sealing surfaces described may be either machined and/or gaskets may be interposed therebetween for sealing purposes.

The manifold flange 47 terminates in a sealing surface 48 which is, as noted, in sealing engagement with the reed valve plate 46. This surface 48 is formed with a plurality of idle airflow passages. These passages comprise a first series of idle passages 49, each of which extends from a respective one of the passages 39 adjacent their outlet ends 42 and 43 so as to provide a small-flow path therebetween. In addition, the pairs of passages are connected with each other by a second series of idle passages 51. The passages 51 connect the uppermost lower intake passage portion 43 with the next lower adjacent upper intake passage portion 42. Hence, the idle passages 49 and 51 form a continuous flow path between each of the intake passages 39 of the intake manifold 38.

An idle air inlet port 53 is also formed in the surface 48 and, in this embodiment, this port 53 intersects the uppermost idle passage 49 for the uppermost pair of intake passages 39. The passage 53 has its inlet end open to the atmosphere so that atmospheric air may bypass the throttle valves 31 when the throttle valve plates 33 are in their fully closed positions and thus provide idle air flow to the engine.

An adjusting screw 54 is mounted in the manifold body 38 and intersects the atmospheric passage 53 for adjusting its effective flow area and, accordingly, the idle speed of the engine. The advantages of this arrangement are that the throttle valves 31 can be maintained in a closed position at idle and also that external piping is not required so as to provide the idle bypass airflow.

In addition to the air which flows to the engine 12 through the air path already described, a fuel charge is also delivered into the induction system 22. This is provided by a plurality of pairs of fuel injectors 55, each of which includes a respective electronically operated fuel injector 58 that is fitted into one of a pair of bores formed in the throttle bodies 27 and which intersect the induction passages 28 downstream of the throttle valves 31 in all positions of the throttle valves. The fuel injectors 56 of each of the pairs 55 are provided with fuel through short fuel rails 57 which extend transversely across the throttle bodies 29 on their upper sides. The fuel rails 57, in turn, receive fuel from a fuel inlet manifold 58 (FIG. 3) which, in turn, receives fuel from a fuel source, indicated by the arrow S, through an inlet fitting 59.

A return manifold 61 extends across the opposite sides of the fuel rails 57 and either contains a pressure relief valve for setting the pressure at which fuel is delivered to the injector 56 or communicate with a remotely positioned pressure control valve through a conduit 62. The pressure is maintained by dumping fuel back into the fuel system somewhere on the upstream side of the delivery manifold 58.

In the embodiment of the invention as thus far described, the atmospheric air inlet passage 53 was positioned adjacent one of the throttle bodies 27 and specifically the uppermost one. In some instances, this may provide an unequal airflow to the various intake passages 28.

Figure 7:
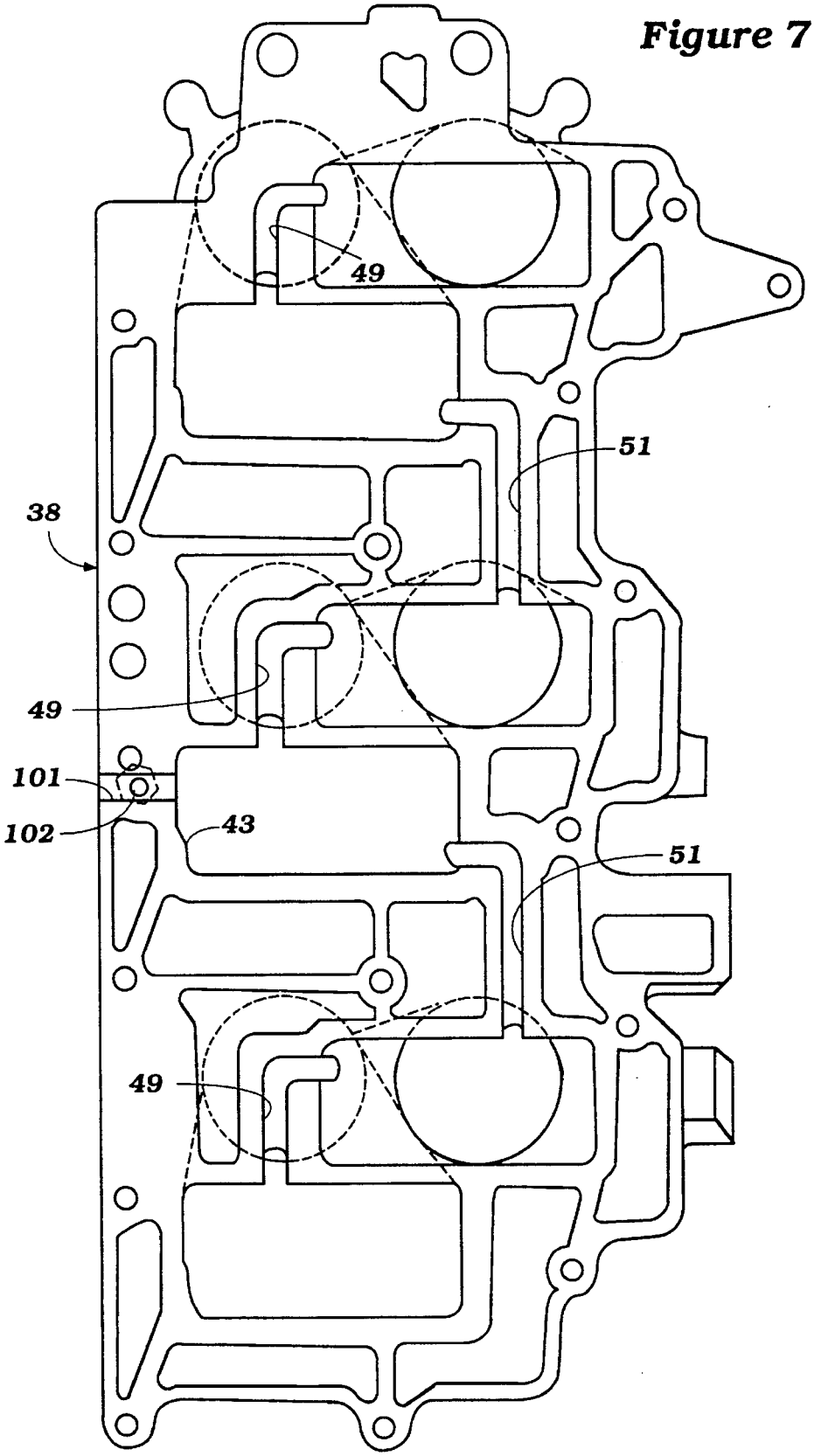
FIG. 7 is a view, in part similar to FIG. 5, and shows another embodiment of the invention.

FIG. 7 shows another embodiment of the invention which differs from that previously described only in the location of the atmospheric idle air inlet and, for that reason, components of this embodiment which are the same as those previously described have been identified by the same reference numerals and will not be described again. In this embodiment, the center of the manifold 38 is provided with an atmospheric air inlet passage 101 that intersects the centermost throttle body passages 43. An idle air adjusting screw 102 controls the air flow through this passage 101, and hence the idle speed of the engine. In all other regards, this embodiment is the same as those previously described and, therefore, further description of it and its operation is not believed to be necessary to enable those skilled in the art to practice the invention.

Figure 8:
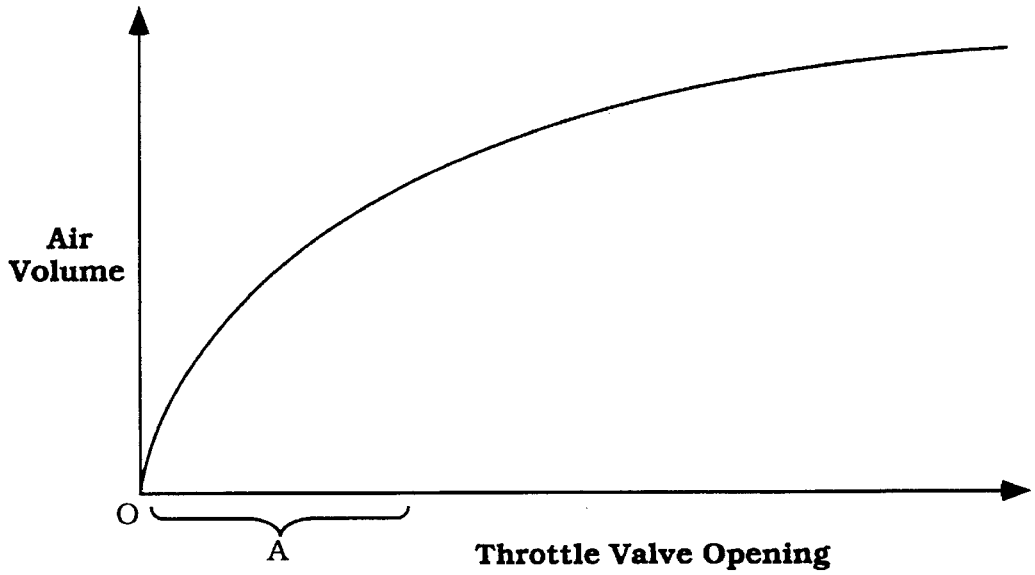
FIG. 8 is a graphical view showing the relationship of intake air volume in relation to throttle valve opening in conjunction with a conventional throttle valve arrangement.
Figure 9:
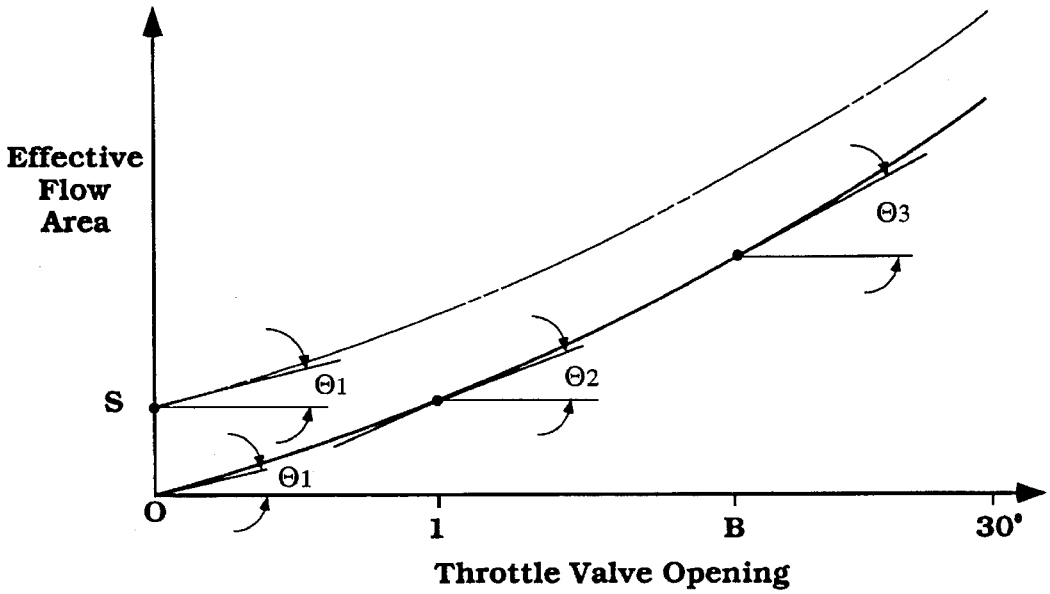
FIG. 9 is a graphical view showing the relationship of effective flow area in relationship to throttle valve opening in degrees for a conventional arrangement, as shown in the solid-line view, and in accordance with the invention, as shown in the dot-dash line view is the range A at FIG. 8.

As has been noted, the described constructions permit the idle speed of the engine to be accurately controlled and does not necessitate controlling the position of the flow controlling throttle valves 31 for this purpose. This also eliminates the necessity of external plumbing for the idle air flow. As has been noted, this arrangement also provides a more easily controlled idle speed and this may be understood best by reference to FIGS. 8 and 9. These figures show, respectively, air flow volume and effective flow area at various angular positions of the throttle valves 31. As may be seen in the low speed range, which includes idle, indicated by the bracket A in FIG. 8, small changes in throttle valve position cause rather abrupt changes in air volume flow. As may be seen in FIG. 9, which is an enlarged view of the area A, the slope of the effective flow area curve in relation to throttle opening changes significantly in this range. This is because of the nature of the relationship of the throttle valve position in the intake passage. By providing the idle air flow at the point S, then the idle speed can be maintained the same as when the throttle valve is open to the point I and thus an area where the curve slope varies significantly can be avoided. Thus, upon opening of the throttle valve the amount of air flow does not vary as greatly and better throttle response is achieved.

From the foregoing description it should be readily apparent to those skilled in the art that the described constructions are merely preferred embodiments of the invention. Various changes and modifications may be made without departing from the spirit and scope of the invention, as defined by the appended claims.

I claim:

1. An intake system for an internal combustion engine having a plurality of intake ports serving a plurality of combustion chambers of the engine, a throttle body assembly affixed to said engine and having a plurality of flow passages, each communicating with a respective one of said intake ports, a plurality of throttle valves supported in said throttle body assembly for controlling the flow through said flow passages and said intake ports, said throttle body assembly including an idle air passage formed integrally therein downstream of said throttle valves and having an atmospheric idle air inlet independent of said flow passages for drawing atmospheric air and delivering it to said intake ports for idle operation.

2. An intake system for an internal combustion engine having a plurality of intake ports serving a plurality of combustion chambers of the engine as set forth in claim 1, wherein the throttle valves are maintained in a closed position at idle and idle speed is adjusted by adjusting the flow through the atmospheric idle air inlet.

3. An intake system for an internal combustion engine having a plurality of intake ports serving a plurality of combustion chambers of the engine as set forth in claim 1, wherein there is a single atmospheric idle air inlet for the idle air passages for each of the flow passages.

4. An intake system for an internal combustion engine having a plurality of intake ports serving a plurality of combustion chambers of the engine as set forth in claim 3, wherein the atmospheric idle air inlet is disposed at the center of the throttle body assembly.

5. An intake system for an internal combustion engine having a plurality of intake ports serving a plurality of combustion chambers of the engine as set forth in claim 1, further including means for controlling the air flow through the atmospheric idle air inlet for controlling the idle speed of the engine.

6. An intake system for an internal combustion engine having a plurality of intake ports serving a plurality of combustion chambers of the engine as set forth in claim 5, wherein the means for controlling the flow through the atmospheric idle air inlet controls the flow to all of the flow passages.

7. An intake system for an internal combustion engine having a plurality of intake ports serving a plurality of combustion chambers of the engine as set forth in claim 6, wherein the atmospheric idle air inlet is disposed at the center of the throttle body assembly.

8. An intake system for an internal combustion engine having a plurality of intake ports serving a plurality of combustion chambers of the engine as set forth in claim 1, wherein the idle air passage is formed in a face of an element of the throttle body assembly.

9. An intake system for an internal combustion engine having a plurality of intake ports serving a plurality of combustion chambers of the engine as set forth in claim 8, wherein the idle air passage is formed by a groove in the face of the element and which is closed on at least one side by engagement of the one face with another element of the induction system.

10. An intake system for an internal combustion engine having a plurality of intake ports serving a plurality of combustion chambers of the engine as set forth in claim 9, wherein the other element comprises the intake manifold of the engine.

11. An intake system for an internal combustion engine having a plurality of intake ports serving a plurality of combustion chambers of the engine as set forth in claim 9, wherein the throttle valves are maintained in a closed position at idle and idle speed is adjusted by adjusting the flow through the atmospheric idle air inlet.

12. An intake system for an internal combustion engine having a plurality of intake ports serving a plurality of combustion chambers of the engine as set forth in claim 11, wherein there is a single atmospheric idle air inlet for the idle air passage for all of the flow passages.

13. An intake system for an internal combustion engine having a plurality of intake ports serving a plurality of combustion chambers of the engine as set forth in claim 12, wherein the atmospheric idle air inlet is disposed at the center of the throttle body assembly.

14. An intake system for an internal combustion engine having a plurality of intake ports serving a plurality of combustion chambers of the engine as set forth in claim 8, wherein the throttle body assembly is comprised of a plurality of pairs of flow passages each serving a respective intake port in side-by-side relationship.

15. An intake system for an internal combustion engine having a plurality of intake ports serving a plurality of combustion chambers of the engine as set forth in claim 14, wherein the intake ports of the pairs are staggered relative to each other.

16. An intake system for an internal combustion engine having a plurality of intake ports serving a plurality of combustion chambers of the engine as set forth in claim 15, wherein the idle air passage comprises a first series of passages interconnecting the flow passages of the pairs and a second series of passages connecting one of the flow passages of one of the pairs with an adjacent flow passage of an adjacent pair.

* * * * *